US006406405B1

(12) United States Patent
Chu

(10) Patent No.: US 6,406,405 B1
(45) Date of Patent: Jun. 18, 2002

(54) FLARED AND WEIGHTED FACIAL MUSCLE EXERCISING DEVICE

(76) Inventor: Chia Chen Chu, 4350 Macronald Dr., La Mesa, CA (US) 91941

( * ) Notice: Subject to any disclaimer, the term of this patent is extended or adjusted under 35 U.S.C. 154(b) by 0 days.

(21) Appl. No.: 09/877,444

(22) Filed: Jun. 11, 2001

Related U.S. Application Data

(63) Continuation-in-part of application No. 09/802,559, filed on Mar. 12, 2001.

(51) Int. Cl.[7] ..... A63B 23/03

(52) U.S. Cl. ..... 482/11; 482/124; 482/128; 604/104

(58) Field of Search ..... 482/10, 11, 112, 482/126, 121, 128, 140; 604/104–109, 164.1, 913

(56) References Cited

U.S. PATENT DOCUMENTS

| | | | |
|---|---|---|---|
| 3,528,655 | A | 9/1970 | Ruderian |
| 3,938,508 | A | 2/1976 | Buckner |
| 4,196,902 | A | 4/1980 | Borriello |
| 4,280,696 | A | 7/1981 | Ramon |
| 4,671,260 | A | 6/1987 | Buckner |
| 5,556,357 | A | 9/1996 | Hanna |
| D397,173 | S | 8/1998 | Edell |
| 5,919,115 | A | 7/1999 | Edell |

FOREIGN PATENT DOCUMENTS

| | | |
|---|---|---|
| WO | PCTUS9806750 | 5/1998 |

*Primary Examiner*—Jerome W. Donnelly
(74) *Attorney, Agent, or Firm*—Charles H. Thomas

(57) ABSTRACT

A facial muscle exercising device has flared and weighted lip-engaging members biased apart by a compressed coil spring. The lip-engaging members include exposed ends that extend longitudinally outwardly away from the user's face and which have a sufficient weight that the user's cheek muscles are required to overcome the gravitational force acting on the outwardly projecting ends of the device. The facial muscle exercising device also has inner ends that project into the mouth cavity, and which are flared transversely outwardly to follow the contour of and contact the inner cheek surfaces of the user's mouth. Preferably, the exposed outwardly projecting ends have removable weights so that the gravitational force to be overcome can be varied to the extent desired by the user. The removable weights may be stainless steel desks that are held in seats formed in the distal extremities of the outwardly projecting ends of the facial muscle exercising device. The device itself may be formed with magnets that hold the stainless steel desks in position in weight-receiving seats formed in the distal extremities of the outwardly projecting ends of the exercising device.

20 Claims, 8 Drawing Sheets

FLARED AND WEIGHTED FACIAL MUSCLE EXERCISING DEVICE

The present invention is a continuation in part of U.S. application Ser. No. 09/802,559 filed Mar. 12, 2001, presently pending.

BACKGROUND OF THE INVENTION

1. Field of the Invention

The present invention relates to a device useful for exercising a person's facial muscles to improve muscle tone and enhance elasticity of the facial muscles.

2. Description of the Prior Art

It is well known that as a person ages the facial muscles of an individual lose tone and elasticity and tend to sag. The loss of tone and elasticity of the facial muscles creates wrinkles and jowls on a person's face. This deterioration in facial muscle tone and elasticity very significantly detracts from the person's appearance and can cause loss of self esteem and even psychological depression.

To combat this effect of aging it is helpful to exercise the facial muscles in a way that prevents their loss of tone and elasticity. The normal facial movements of a person in speaking, chewing, smiling, frowning, and so forth do not achieve the required exercising of the correct muscles to a sufficient degree.

Various devices have been developed for the purpose of aiding a person in exercising the facial muscles to retain elasticity and prevent loss of muscle tone. These devices are held within the lips of a person's mouth and operated by pursing the lips together to overcome a spring bias. Conventional devices of this type are described in U.S. Pat. Nos. 4,671,260; 5,919,116; 5,556,357; 3,938,508; 3,528,655; 4,280,696; 4,196,902; U.S. Pat. No. Des. 397,173; and PCT/US98/06750. However, the conventional devices which have been developed for this purpose are uncomfortable to use and difficult to operate. As a consequence, while a person may use these conventional devices for a short time, they are very often set aside completely or utilized only sporadically.

SUMMARY OF THE INVENTION

The present invention involves a facial muscle exercising device and a unique method of utilizing that device. The facial muscle exercising device of the invention is comprised of a pair of transversely separated, lip-engaging members. The lip-engaging members have exposed ends that extend longitudinally outwardly from a person's face when the device is properly positioned in a person's mouth. At least one of these members has a transverse guideway defined in its exposed end while the other lip-engaging member has an elongated guide element that extends into the guideway. A compressed spring having opposing ends is seated in the facing sides of the lip engaging members and biases them apart.

To utilize the facial muscle exercising device, the user purses and unpurses his or her lips repeatedly. This action overcomes the bias of the compressed spring and forces the lip-engaging members toward each other. The interaction between the guide and the guideway ensures that the lip-engaging members remain in an orientation substantially parallel to each other.

Because the lip-engaging members have exposed ends that project outwardly in a cantilevered fashion relative to the user's lips, the use of the device provides an added dimension to facial muscle exercising. Specifically, the force of gravity on the outwardly projecting, exposed ends of the lip-engaging members provides a mild-to-moderate stress to the facial muscles that produces a significant improvement to retention of facial muscle tone and strength.

As the user's lips are pursed, the weighted ends of the lip-engaging members are forced upwardly, overcoming the force of gravity. The force required by the user's cheek and jaw muscles to overcome the force of gravity on the weighted ends of the device improves the benefits of the facial muscle exercise. The added benefit of overcoming the gravitational force helps preserve the suppleness and smoothness of a person's cheeks and jaw, and significantly retards the slackness of facial skin and the development of jowls that is so characteristic of the aging process. The use of the facial muscle exercising device of the invention aids the user in retaining a youthful facial appearance.

The advantageous benefits of the facial muscle exercising device of the invention may be augmented by the use of removable weights as part of the device. The weights are attached to the distal extremities of the exposed ends of the lip-engaging members that project out from the person's mouth. These weights may be attached to the protruding ends of the device by either mechanical or magnetic means. In one preferred embodiment of the invention small magnets are permanently embedded in the extremities of the protruding ends of the lip-engaging members. Weights formed of a material attracted by magnetism can then be removably attached to the distal extremities of the protruding ends of the lip-engaging members. The weights remain in position due to the force of magnetic attraction exerted by the embedded magnets.

In a further improved form of construction the lip-engaging members are provided with opposing cheek-engaging ends that project longitudinally inwardly into the mouth cavity in a direction opposite the protruding exposed ends. Also, the cheek-engaging ends are flared outwardly in opposite transverse directions from each other to form convex, relatively broad, cheek-contacting surfaces. The provision of outwardly flared ends to the portions of the lip-engaging pieces that are located in the mouth cavity reduce the tendency of the device to fall out of the user's mouth. Different degrees of flaring are more comfortable to different users.

Another important aspect of the invention is the use of the device while holding the head in different positions. Significant benefits are gained by manipulating the lip-engaging components of the device with the head held erect in a conventional upright, forward facing position with the user's chin at a vertical level below the level of the user's mouth. However, the facial muscles are exercised in a different manner if the user lies on his or her back in a supine position. When the device is manipulated while lying in this position the user's chin is at essentially the same vertical level as the user's mouth. The force of gravity on the weighted ends of the lip-engaging members then acts vertically downwardly. The facial muscles are thereupon exercised in a somewhat different manner.

The user's facial muscles are exercised in still a different manner when the user utilizes the device with his or her head tilted far back so that the level of the user's chin is above the level of the user's mouth. This can be done by lying in a supine position on a bed with one's head tilted far back out over the end of the bed. This can also be done by standing on one's head. When utilized in this position the force of gravity tends to rotate the weighted outwardly projecting ends of the device downwardly toward the top of the user's head, and away from the user's chin. The force exerted by the facial muscles to overcoming the force of gravity on the weighted ends of the device with the head held in this position provides very significant benefits to the retention of facial muscle tone.

In one broad aspect the present invention may be considered to be a facial muscle exercising device comprising a pair of transversely separated lip-engaging members having mutually facing sides and opposing, opposite sides in which concave outwardly facing lip-receiving grooves are formed. The lip-engaging members have exposed ends that extend longitudinally outwardly from the lip-receiving grooves. A transverse guideway is defined in the exposed end of at least one of the lip-engaging members. An elongated guide element projects from the facing side of the other of the lip-engaging members. The guide element projects into the guideway of the first member.

The invention is also comprised of a compressed spring having opposing ends seated in the facing sides of the lip-engaging members. The spring is located longitudinally inwardly from the guide element and guideway. Preferably, the spring is aligned with the lip-receiving grooves so that it is located right between the user's lips.

In another aspect the invention may be considered to be a method for a human being to maintain muscle tone and elasticity of the cheek muscles adjacent the mouth utilizing a facial muscle exercising device. The facial muscle exercising device employed has a pair of transversely separated, opposing lip-engaging pieces biased apart by a spring. The device is formed with mutually facing and mutually opposing sides. Concave, lip-engaging grooves are defined on the opposing sides of the lip-engaging pieces. The protruding, exposed ends project longitudinally out from the concave lip-engaging groups. A transverse guide rod is anchored to one of the lip-engaging pieces and extends between the mutually facing sides and into a transverse guideway in the other of the lip-engaging pieces in a reciprocal sliding engagement therewith.

The steps of the method involve positioning the facial muscle exercising device in one's mouth with the lip-engaging grooves disposed at the corners of one's mouth. The user then repetitively purses his or her lips to contract the cheek muscles to overcome the bias of the spring and the force of gravity on the exposed ends of the facial muscle exercising device. As previously indicated, different benefits of the practice of the method are achieved when the exercise is performed with the head held in a position in which one's chin is at a vertical level below the mouth, at the same vertical level as the mouth, or at a vertical level above the level of the mouth.

The invention may be described with greater clarity and particularity by reference to the accompanying drawings.

DESCRIPTION OF THE EMBODIMENT

Figure 1:
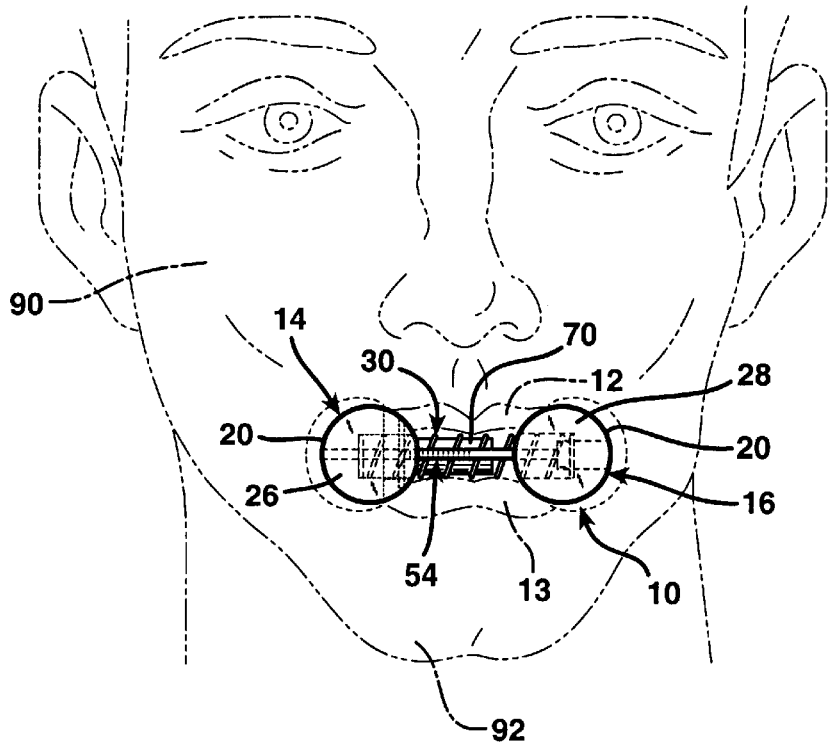
FIG. 1 is an elevational view illustrating the use of one preferred embodiment of the facial muscle exercising device of the invention positioned in the mouth of a user whose face is shown in phantom.
Figure 2:
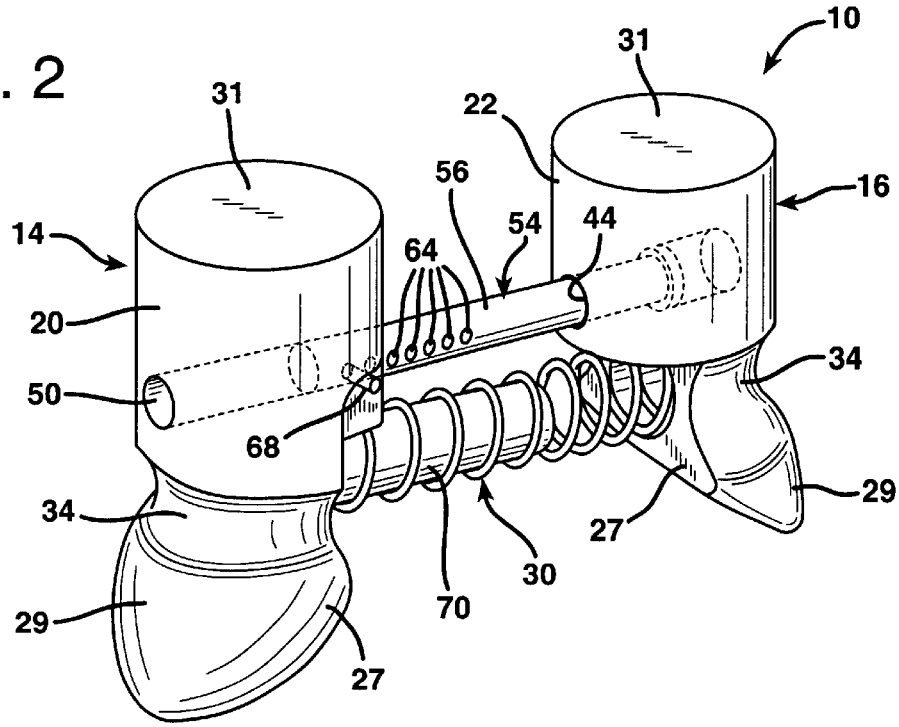
FIG. 2 is a perspective view of the embodiment of the facial muscle exercising device shown in FIG. 1.
Figure 3:
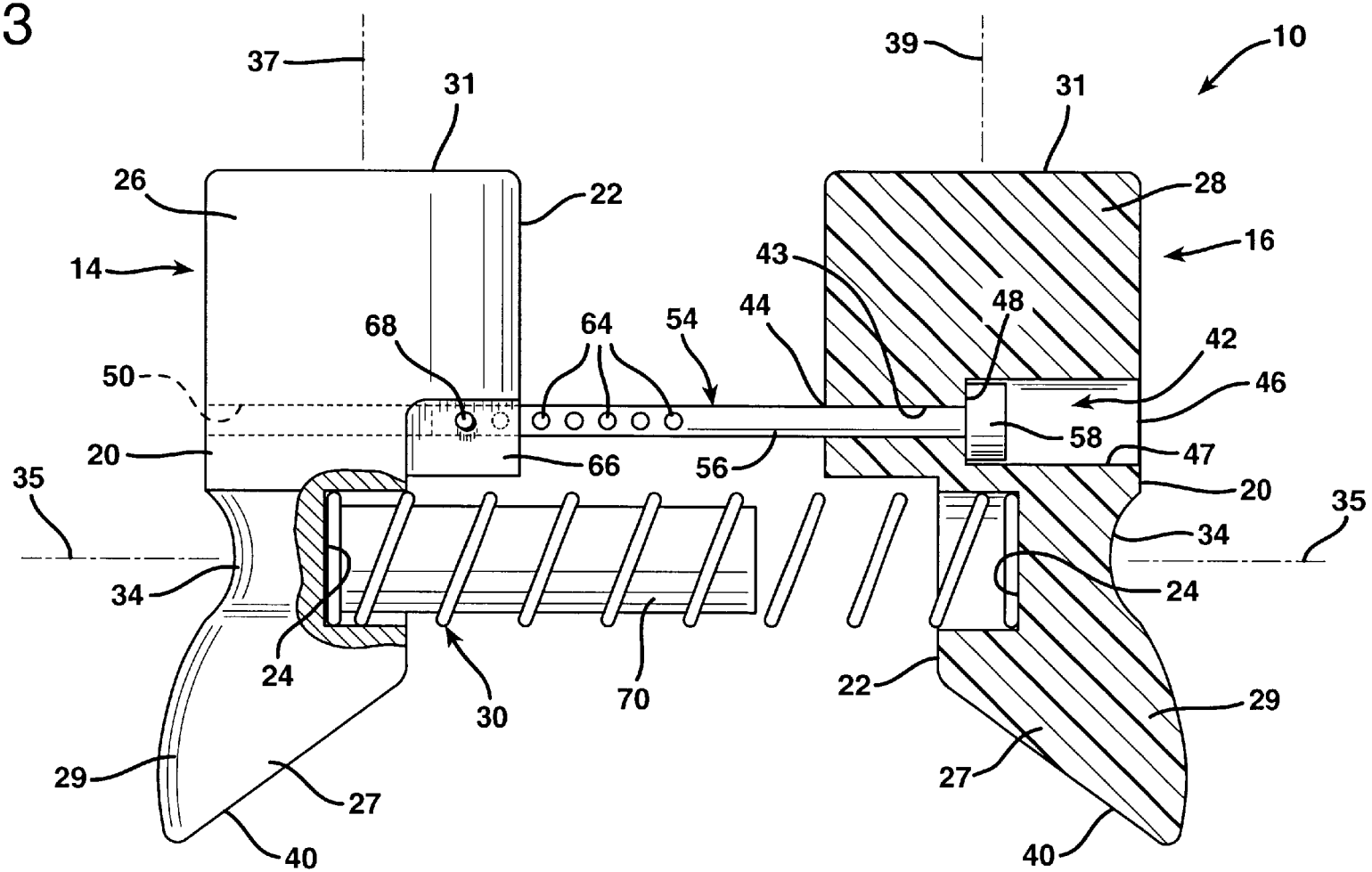
FIG. 3 is an elevational view, partially in section, of the facial muscle exercising device shown in FIG. 2 with the lip-engaging pieces biased apart from each other.
Figure 4:
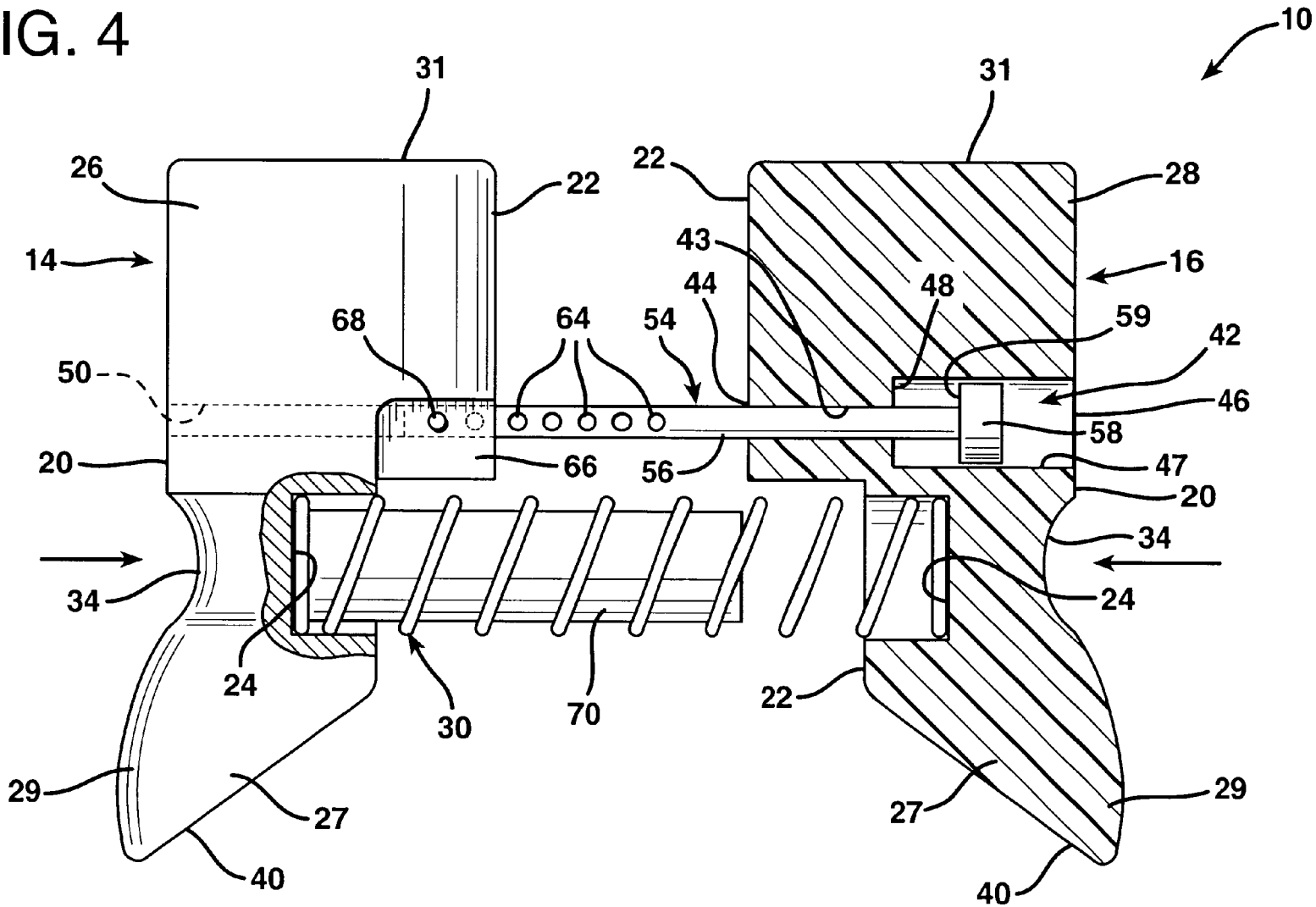
FIG. 4 is an elevational view, partially in section, of the facial muscle exercising device shown in FIG. 2 with the lip-engaging pieces pressed toward each other.

FIG. 1 illustrates a facial muscle exercising device indicated generally at 10 positioned for use in the mouth of a person whose upper lip is indicated at 12 and whose lower lip is indicated at 13. As illustrated, the facial muscle exercising apparatus 10 is designed for insertion between the lips 12 and 13 of the person's mouth.

The facial muscle exercising apparatus 10 is comprised of a pair of lip-engaging pieces 14 and 16 which are disposed in transverse separation from each other and which have mutually opposing, convex outwardly curved sides 20 and opposite, mutually facing sides 22 in which transversely separated, longitudinally aligned, cylindrical-shaped sockets 24 are defined. A compressed coil spring 30 has opposing ends that are coaxially seated in the sockets 24 for compression between the inner surfaces 22 of the end pieces 14 and 16. The coil spring 30 operates to bias the lip-engaging pieces 14 and 16 apart from each other.

The lip-engaging pieces 14 and 16 both have concave lip-engaging grooves 34 defined on their opposing sides 20 at the longitudinal locations thereon in which the sockets 24 are formed. The lip-engaging pieces 14 and 16 have protruding cylindrical exposed ends 26 and 28, respectively, that project longitudinally out from the concave lip-engaging grooves 34. Opposite the protruding exposed ends 26 and 28, both of the lip-engaging pieces 14 and 16 have cheek-engaging ends 27 that project longitudinally in toward the mouth cavity from the concave lip-engaging grooves 34. The longitudinal axes of alignment of the lip-engaging pieces 14 and 16 are respectively indicated at 37 and 39.

The cheek-engaging ends 27 include convex, transverse outwardly flared cheek contact surfaces 29 on the mutually opposing sides 20 of the lip-engaging pieces 14 and 16. The cheek-engaging surfaces 29 have a radius of curvature of about one inch, and terminate at a linear distance of about 1.5 inches as measured from the centers of the lip-engaging grooves 34 to the distal tips of the cheek-engaging ends 27, measured along the convex outwardly, arcuately curved surfaces 29 on the outwardly curved sides 20.

Each of the lip-engaging pieces 14 and 16 is formed of injection molded plastic. The protruding exposed ends 26 and 28 both have a cylindrical shape about 1 5/16 inches in diameter about their respective longitudinal axes 37 and 39. Each of the protruding exposed ends 26 and 28 is about two inches in longitudinal, axial length as measured in a longitudinal distance along the longitudinal axes 37 and 39 to the transverse plane of symmetry 35 that bisects the concave, arcuate grooves 34.

The concave, arcuate grooves 34 are each about one-half of an inch wide and about 0.100 inches in depth. The grooves 34 are defined in the outwardly facing, outboard sides 20 of the lip-engaging pieces 14 and 16 immediately adjacent the cylindrical ends 26 and 28. The plane of symmetry 35 of the grooves 34 is parallel to the mutual alignment of the sockets 24 and perpendicular to the longitudinal axes 37 and 39 of the outwardly protruding exposed ends 26 and 28.

An arcuate segment having a radial dimension of about five-sixteenths of an inch and an axial dimension of about one-half inch is removed from the mutually facing inner sides 22 of the end pieces 14 and 16 opposite the grooves 34, so that the surfaces of the inner sides 22 into which the sockets 24 are formed are flat, mutually parallel to each other, and are both parallel to the axes of longitudinal alignment 37 and 39.

The circumference of the convex, outwardly facing surface at the bottom of the trough of each of the grooves 34 extends over an arc of between about 180 degrees and about 250 degrees as measured in the plane of symmetry 35. In the preferred embodiment of the invention described, this arc is about 240 degrees and contacts the lips 12 and 13 of the user throughout when the facial muscle exercising device 10 is utilized, as indicated in FIG. 1.

The sockets 24 are about five-eighths inches in diameter at the flat surfaces of the inner sides 22 of the lip-engaging pieces 14 and 16 in which they are formed. The inner end faces 40 of the noncylindrical, outwardly flared cheek-engaging ends 27 of the lip-engaging pieces 14 and 16 are flat, but are not parallel to the outer circular faces 31 of the cylindrical protruding exposed ends 26 and 28 of the lip-engaging pieces 14 and 16, respectively . Rather, the inner end faces 40 of the lip-engaging pieces 14 and 16 are inclined at an angle of about 45 degrees relative to the axes 37 and 39 of the cylindrical outwardly protruding exposed ends 26 and 28. Each end piece 14 and 16 has a longitudinal axial length, as measured along the axes 37 and 39, of about two inches.

At least one of the lip-engaging pieces 14 and 16 has a guideway defined therein. Preferably, guideways are defined in both of the lip-engaging pieces 14 and 16. In the embodiment illustrated in FIGS. 1–6, the guideway 42 defined through the lip-engaging piece 16 is a transverse passageway that extends through the cylindrical protruding exposed end 28. The passageway 42 has a stepped cross section and has a narrower portion 43 that intersects the facing side 22 of the lip-engaging piece 16 at a guide element shank opening 44. The opening 44 at the inner side 22 of the lip-engaging piece 16 is of reduced cross-sectional area from the opening 46 at the opposite outer side 20. The passageway 42 narrows abruptly at a demarcation formed by an annular abutment shoulder 48 from a maximum diameter of about nine-sixteenths of an inch at its wider portion 47 to about seven-sixteenths of an inch at its narrower portion 43. The annular abutment shoulder 48 is located at about the axial center of the outwardly protruding end 28. The internal abutment shoulder 48 is thereby directed toward the outwardly facing side 20 and is located within the cylindrical, protruding, exposed end portion 28 of the lip-engaging piece 16.

The guideway formed in the lip-engaging piece 14 is a cylindrical passageway 50 defined in a transverse direction completely through the cylindrical, protruding exposed end 26 of the lip-engaging piece 16. The diameter of the passageway 50 is about seven-sixteenths of an inch. When the components of the facial muscle exercising device 10 are assembled together, the passageways 42 and 50 defined through the structures of the lip-engaging pieces 16 and 14, respectively, are coaxially aligned with each other in a transverse direction.

The facial muscle exercising device 10 is further comprised of a longitudinally elongated guide element which is a guide rod 54. The guide rod 54 has a shank 56 with an enlarged disc-shaped head 58 at one of its ends. The demarcation between the shank 56 and the head 58 of the guide rod 54 is formed as a flat, annular abutment face 59. Adjacent to the disc-shaped head 58 the shank 56 is abruptly necked down to a reduced diameter so that the enlarged head 58 is greater in cross-sectional area than the shank 56 at its opposite, distal end remote from the head 58. The opposite, distal end of the shank 56 is about one-quarter of an inch in diameter and has a plurality of closely spaced, transverse catch recesses which are formed as locking openings 64 defined entirely through the structure of the shank 56 at closely spaced intervals. The openings 64 are preferably about one-sixteenth of an inch in diameter and are spaced approximately one-sixteenth of an inch apart all along the end of the shank 56 of the guide rod 54 remote from the head 58.

The narrower portion of 43 of the guideway passage 42 has a cross-sectional area greater than the cross-sectional area of the guide rod shank 56 and less than that of the guide rod head 58. The wider portion 47 of the guideway passage 42 has a cross-sectional area greater than that of both the head 58 and the shank 56 of the guide rod 54.

The guide rod 54 is received within the guide passageways 42 and 50 with the enlarged head 58 disposed outboard from the abutment shoulder 48 so that the relatively narrow diameter shank 56 of the guide rod 54 passes through the opening 44 in the inner side 20 of the lip-engaging piece 16. The opposite end of the shank 56 of the guide rod 54 extends into the cylindrical passageway 50 defined through the structure of the lip-engaging piece 14.

A notch 66 is defined in the cylindrical projecting exposed end 26 of the lip-engaging end piece 14 so as to form a flat surface recessed inwardly from the otherwise cylindrical portion of the lip-engaging piece 14. This flat surface serves as a bearing surface against which the underside of the head of a set screw 68 bears. The set screw 68 is a releaseable locking member that has a threaded shank which is threadably engaged in an internally tapped bore defined in the protruding exposed end 26 of the lip-engaging piece 16. When the set screw 68 is fully advanced into this internally tapped bore, the underside of its head resides in contact with the flat surface formed by the notch 66. At the same time the tip of the shank of the set screw 68 extends through a selected one of the openings 64 defined through the structure of the shank 56 of the guide rod 54. Once the set screw 68 is engaged in a selected opening 64, the guide rod 54 is secured to the lip-engaging piece 14 and the set screw 68 serves as a releaseable locking member for engaging the other end of the guide rod 54, remote from the end bearing the enlarged head 58.

The lip-engaging members 14 and 16 reside at a maximum transverse distance of separation when the abutment face 59 of the guide rod head 58 resides in contact with the abutment shoulder 48 in the guideway 42. The abutment shoulder 48 of the lip-engaging member 16 serves as a guide element stop that limits the extent of withdrawal of the guide rod 54 from the guideway 42.

Figure 5:
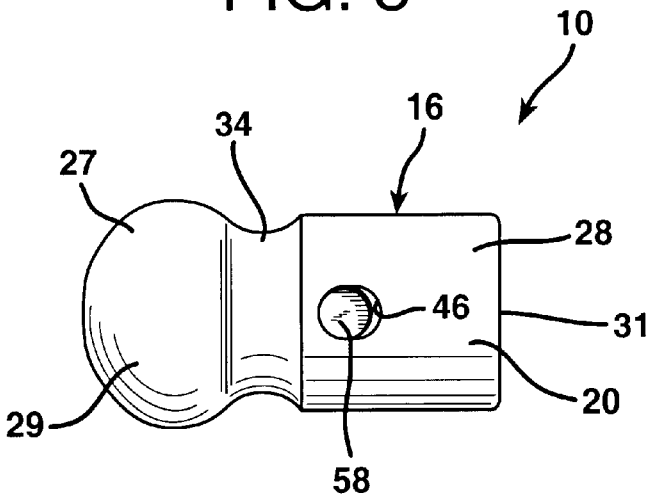
FIG. 5 is a right side elevational view of the facial muscle exercising device shown in FIG. 2 in a fully compressed, latched condition.
Figure 6:
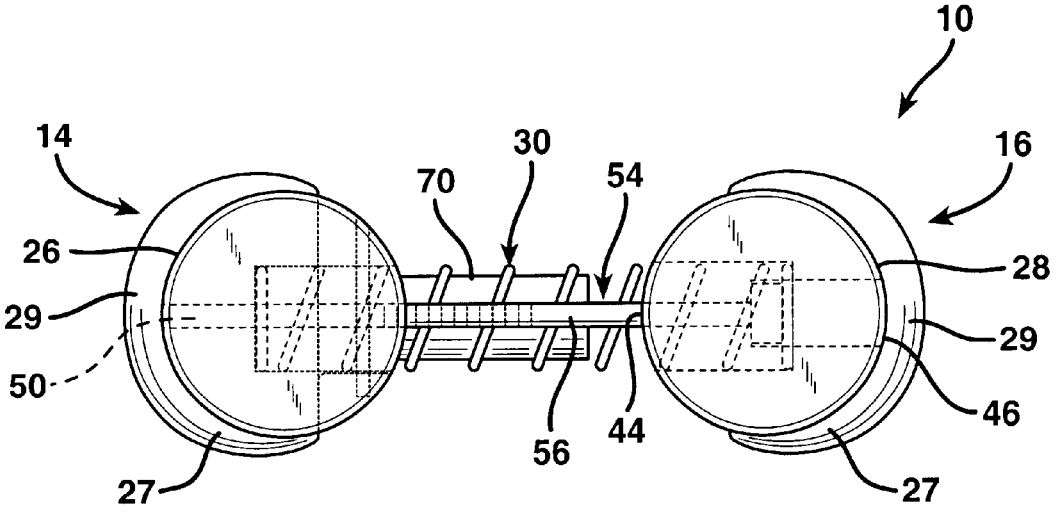
FIG. 6 is a top plan view of the facial muscle exercising device in the condition shown in FIG. 3.

Also, the lip-engaging members 14 and 16 are releaseably securable close together by increasing the compression of the coil spring 30 and partial engagement of the abutment face 59 of the guide rod head 58 with the opposite side 20 of the lip-engaging members 16 at the guide element head opening 46, as illustrated in FIG. 5. This engagement can be achieved by merely laterally deflecting the shank 56 of the guide rod 54 to a slight extent once the guide rod head 58 clears the guide rod head opening 46, and releasing the members 14 and 16 so that the extension of the coil spring 30 presses the abutment face 59 against the opposite, outwardly facing surface 20 of the lip engagement element 16 adjacent the guide rod head opening 46.

To vary the maximum stroke of the guide rod 54 relative to the lip-engaging piece 14 and to adjust the preload of compressive force on the coil spring 30, the set screw 68 may be withdrawn and the shank 56 adjusted longitudinally within the passageway 50 to a desired position. The set screw 68 is then reengaged so that its shank projects into a different selected catch opening 64. The locking set screw 68 may thereby releaseably engage the guide rod shank 56 at a selected location along the length of the end of the guide rod shank 56 remote from the head 58.

In the embodiment of FIGS. 1–6 a tubular plastic spacing member 70 is anchored to the facing surface 22 of the lip-engaging piece 14. The spacing member 70 is seated and adhesively secured in the socket 24 of the lip-engaging member 26 axially within the confines of the coil spring 30. The tubular spacer 70 extends transversely from the facing surface 22 of the lip-engaging member 14 and terminates short of the mutually facing surface 20 of the other lip-engaging member 16 at the maximum transverse distance of separation between the lip-engaging members 14 and 16, illustrated in FIG. 3. The tubular spacer 70 also performs the function of stabilizing the lip-engaging pieces 14 and 16 so that they remain in approximate parallel alignment. Precise parallel alignment is not necessary, and indeed is not particularly desirable, since the lip-engaging pieces 14 and 16 should be able to shift someone from mutually parallel alignment so that the flared, cheek contacting surfaces 29 conform to and remain in contact with the inside surfaces of the user's cheeks.

Figure 7:
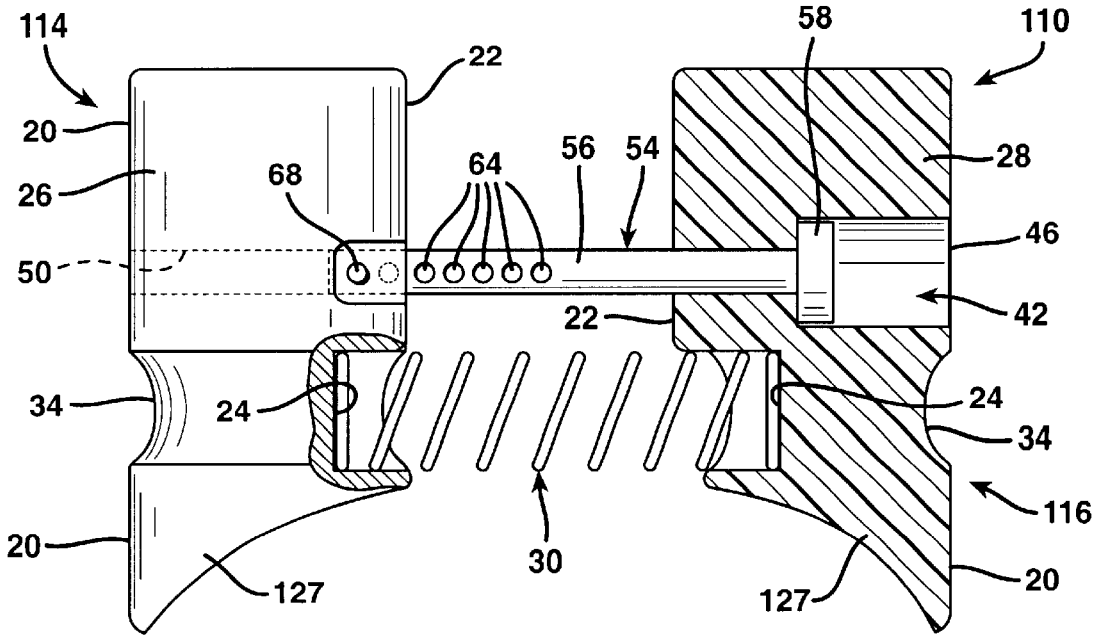
FIG. 7 is an elevational view, partially in section, showing an alternative embodiment of the facial muscle exercising device of the invention.

FIG. 7 illustrates another embodiment of a facial muscle exercising device 110 according to the invention. The facial muscle exercising device 110 includes many of the same components as the facial muscle exerciser 10 and the components common to both embodiments are labeled with the same reference numbers. However, the facial muscle exercising device 110 differs in one significant regard from the facial muscle exerciser 10. Specifically, in the facial muscle exercising device 10 the lip-engaging members 14 and 16 have cheek-engaging ends 27 projecting from the lip-receiving grooves 34 in a longitudinal direction opposite of the exposed ends 26 and 28. Also, the opposing opposite sides 20 of the cheek-engaging ends 27 are flared convex outwardly and beyond the opposite sides 20 of the exposed ends 26 and 28 in a transverse direction. In contrast, the cheek-engaging ends 127 are not flared transversely outwardly, but instead have a cylindrical outer surface formed with the same diameter as the protruding, exposed ends 26 and 28. Also, the ends 127 are much shorter longitudinally than the ends 27 of the embodiment of FIGS. 1–6. For some individuals the facial muscle exercising device 110 is more comfortable to utilize than the facial muscle exercising device 10.

Figure 8:
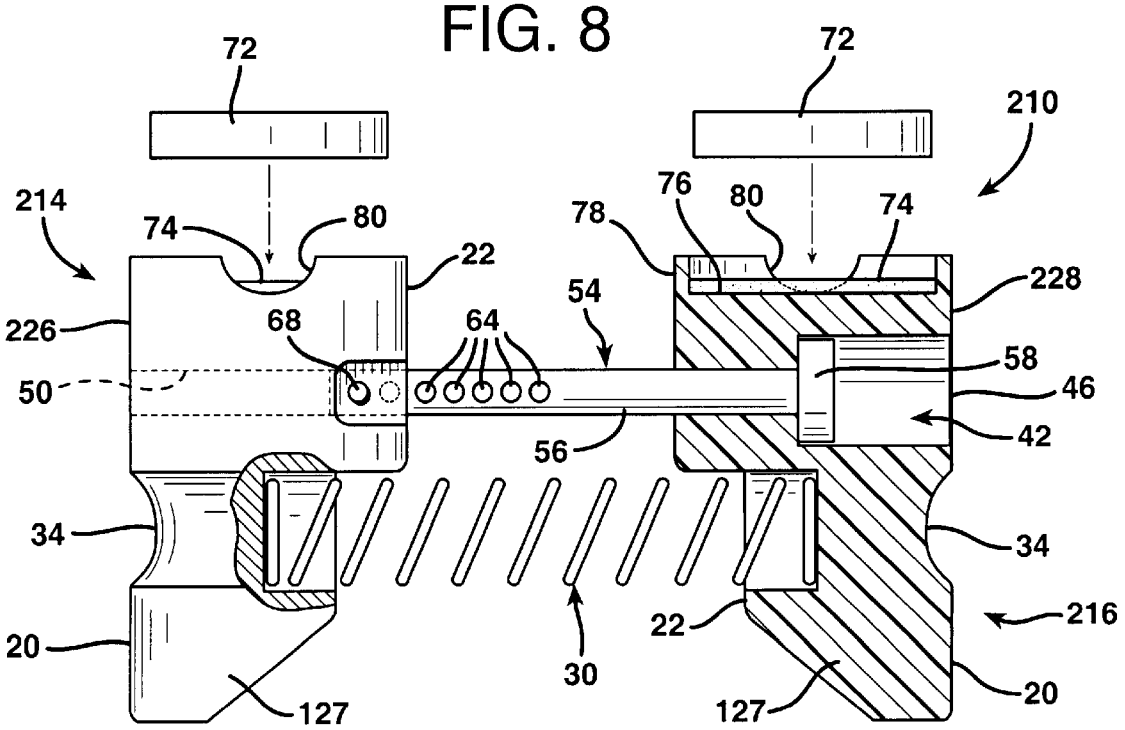
FIG. 8 is an elevational view, partially in section, showing another alternative embodiment of the facial muscle exercising device of the invention.

FIG. 8 illustrates another embodiment 210 of the invention which is similar in many respects to the facial muscle exercising device 110 shown in FIG. 7. Elements common to both embodiments have the same reference numbers. The facial muscle exercising device 210 differs from the embodiment shown in FIG. 7 in that the protruding ends 26 and 28 are long enough, and therefore have a sufficient mass, so that the user must overcome a significant force of gravity acting upon the ends 26 and 28 while performing facial muscle exercises. Typically, each of the ends 26 and 28 has a weight of between about one and ten ounces. The preferred weight of each of the ends 26 and 28 is about two ounces. This weight can be achieved in a plastic material by making the projecting ends 26 and 28 sufficiently long.

In the embodiment of FIG. 8, however, the longitudinally projecting ends 226 and 228 are much shorter. However, the facial muscle exercising device 210 is comprised of detachable weights in the form of stainless steel disks 72 that are releaseably attached to the distal extremities of the exposed ends 226 and 228 remote from the lip-receiving grooves 34. In this connection a disc-shaped magnet 74, formed as a thin wafer, is adhesively secured to central, circular, flat, transverse weight seating surfaces 76 formed at the outer extremities of the projecting ends 226 and 228. The weight seating surfaces 76 are surrounded by raised, annular retaining rims 78 with opposing arcuate finger grip gaps 80 defined therein. The magnets 74 are secured by adhesive to the circular magnet seating faces 76 within the confines of the rims 78. The magnets 74 are thereby permanently secured to the protruding, exposed ends 226 and 228 of the lip-engaging members 214 and 216 at the weight engaging surfaces 76 thereof.

The disc-shaped removable stainless steel weights 72 are attracted by the magnets 74 and are thereby removably held to the weight seating surfaces 76 by the magnetic force of the magnets 74. The stainless steel weights 72 are considerably heavier than a corresponding volume of plastic of which the lip-engaging members 214 and 216 are constructed. Consequently, the projecting ends 226 and 228 of the lip-engaging pieces 214 and 216 can be constructed much shorter than the ends 26 and 28, yet still provide the same muscle stressing benefit since the gravitational force on the removable weights 72 is comparable to the gravitational force on the longer, exposed projecting members 26 and 28. Also, by providing the weights 72 as removable elements, the user is able to select weights of different mass for the muscle exercising device 210 to provide increased or reduced muscle stress.

Figure 9:
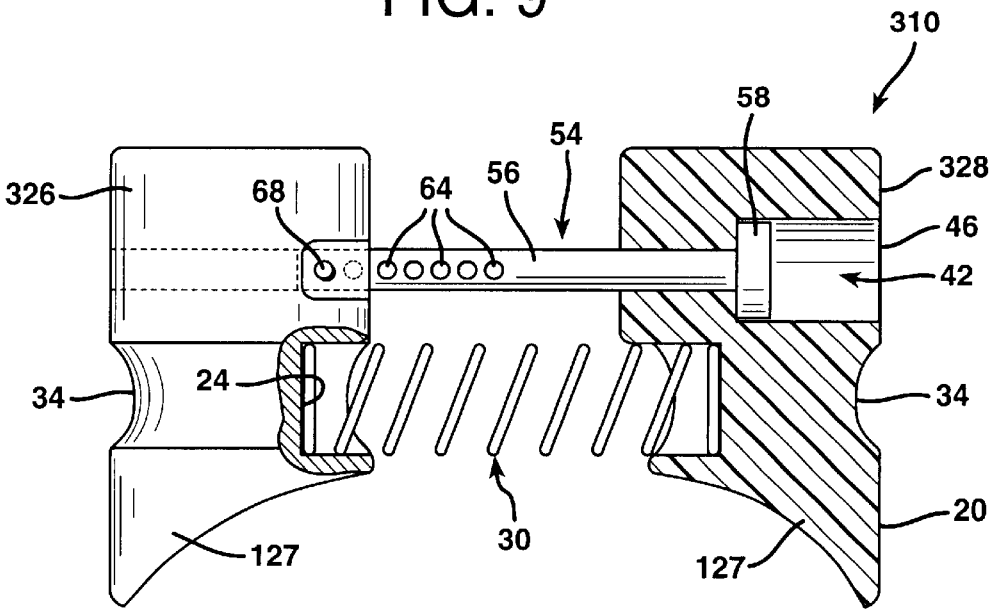
FIG. 9 is an elevational view, partially in section, showing another alternative embodiment of the facial muscle exercising device of the invention.

FIG. 9 illustrates still another embodiment of a muscle exercising device 310. The muscle exercising device 310 shown in FIG. 9 is similar in many regards to the muscle exercising device 110 shown in FIG. 7. Consequently, elements common to both embodiments are labeled with the same reference numbers. The muscle exercising device 310 differs from the muscle exercising device 110 in that the exposed projecting ends 326 and 328 of the muscle exercising device 310 are considerably shorter, and therefore lighter in weight, than the projecting ends 26 and 28 of the muscle exercising device 110. Some individuals consider the muscle exercising device 310 to be more comfortable to use than the muscle exercising device 110.

Figure 10:
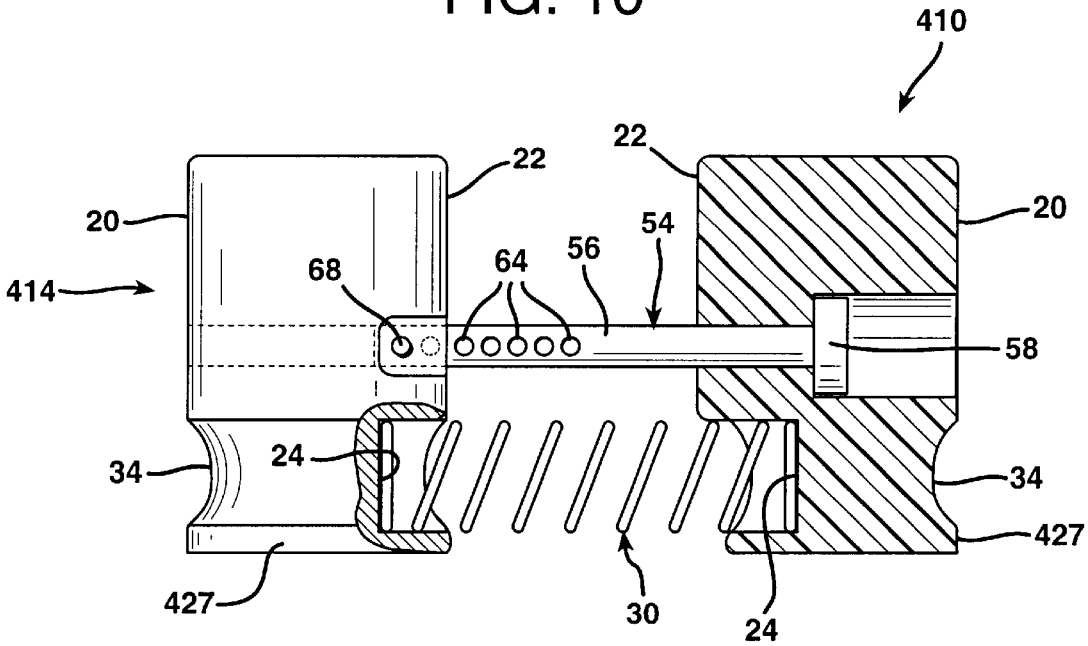
FIG. 10 is an elevational view, partially in section, showing another alternative embodiment of the facial muscle exercising device of the invention.

FIG. 10 illustrates still another modified form of muscle exercising device 410. The muscle exerciser 410 differs from the muscle exerciser 110 shown in FIG. 7 in that it has a much smaller and shorter inner end 427 than the muscle exercising device 110. Again, individual preferences do play a large part in the selection of the particular configuration of the muscle exercising device employed. Some individuals do not like the feel of relatively long inner ends projecting into their mouth cavities. The muscle exercising device 410 avoids such a construction.

Figure 11:
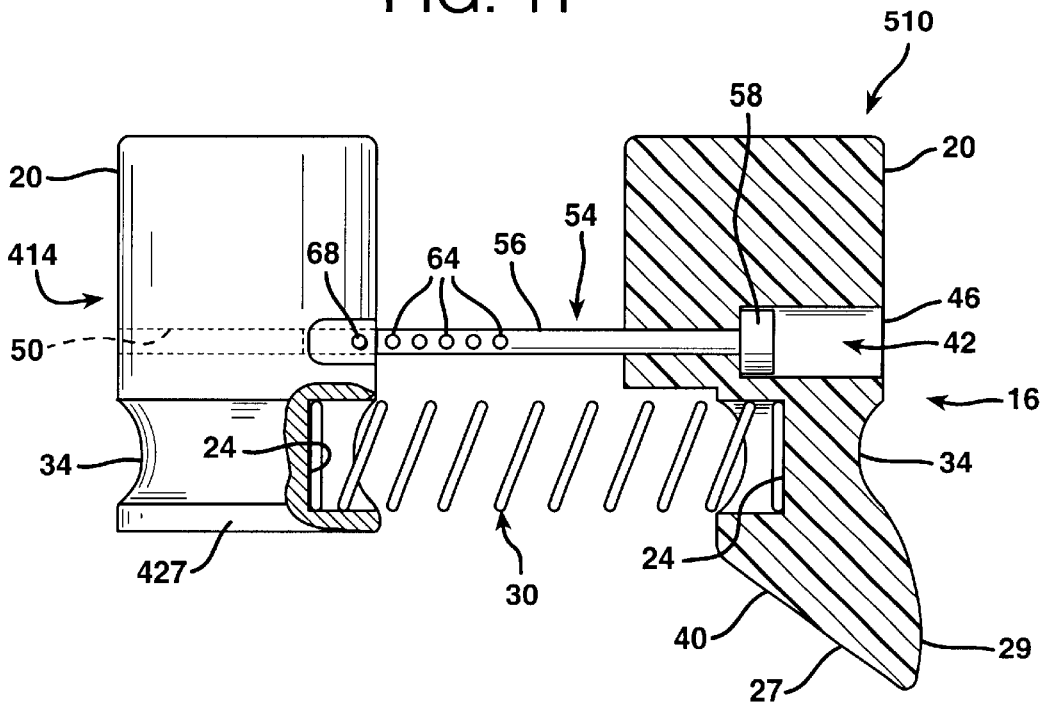
FIG. 11 is an elevational view, partially in section, showing another alternative embodiment of the facial muscle exercising device of the invention.

FIG. 11 illustrates still another alternative embodiment of a muscle exercising device according to the invention. The muscle exercising device 510 employs the lip-engaging member 114 shown in FIG. 7 in combination with the opposing lip-engaging member 16 shown in the embodiment of FIGS. 1–6. Some users prefer to concentrate on the exercise of their cheek muscles one cheek at a time. The muscle exercising device 510 allows a user to do this.

Figure 12:
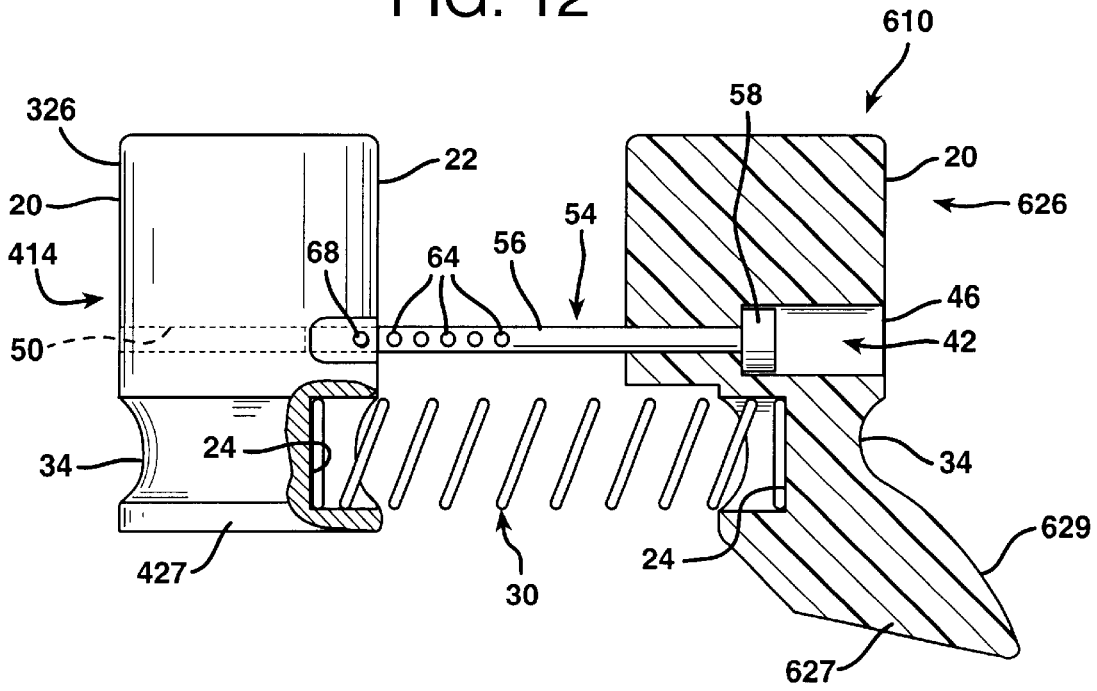
FIG. 12 is an elevational view, partially in section, showing another alternative embodiment of the facial muscle exercising device of the invention.

The facial muscle exercising device 610 shown in FIG. 12 is similar in many respects to the facial muscle exercising device 510 shown in FIG. 11, but employs a lip-engaging member 626 in combination with the lip-engaging member 326. The lip-engaging member 626 is similar in many respects to the lip-engaging member 16, but has an inner projecting end 627 that has a much more pronounced flaring surface 629 that extends a considerable degree further out away from the cylindrical surface of the exposed end 28. Some individuals find that the muscle exercising device 610 is easier to retain in the mouth than other embodiments.

Figure 13:
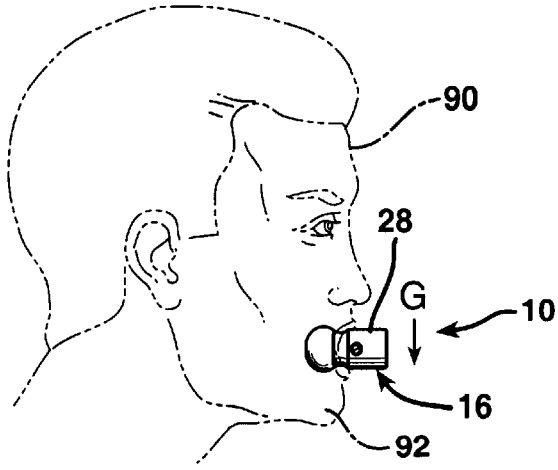
FIG. 13 is a side elevational view showing a facial muscle exercising device utilized in the manner shown in FIG. 1, in which the user's head is in a position in which the user's chin is at a vertical level below the level of the user's mouth.
Figure 14:
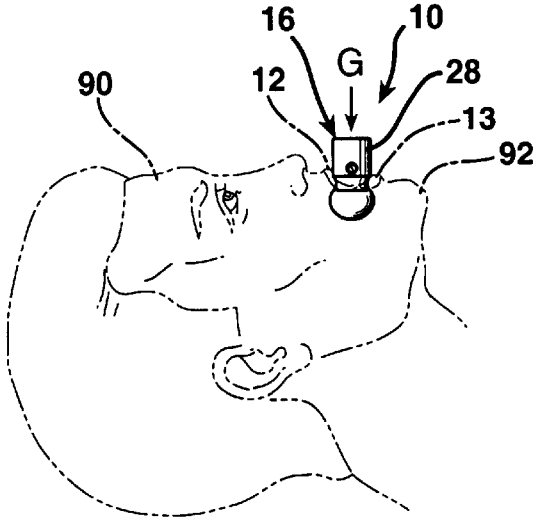
FIG. 14 is a side elevational view showing a facial muscle exercising device of the invention utilized as shown in FIG. 1 with the user's head in a position in which the user's chin is at substantially the same vertical level as the user's mouth.
Figure 15:
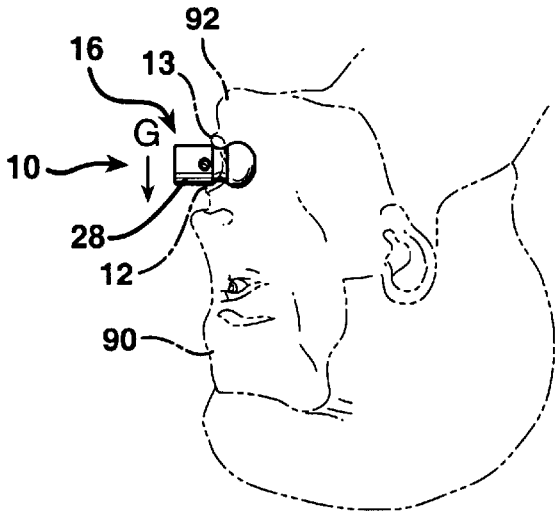
FIG. 15 is a side elevational view showing a facial muscle exercising device of the invention utilized as shown in FIG. 1 with the user's head in a position in which the user's chin is at a vertical level above the user's mouth.

FIGS. 13, 14, and 15 illustrate different techniques for using any and all of the different embodiments of the muscle exercising device of the invention. The muscle exercising device 10 is shown as being utilized with the user's head 90 oriented in different positions. However, it is to be understood that any embodiment of the device of the invention can be utilized has shown in FIGS. 13, 14, and 15.

FIG. 13 is a side elevational view illustrating the use of the muscle exercising device 10 in the same manner as illustrated from the front in FIG. 1. As shown, a gravitational force G acts downwardly upon the protruding ends 26 and 28 of the muscle exercising device 10. When the cheek muscles are relaxed the protruding ends 26 and 28 will tend to sag downwardly away from the lips of the user. When the user purses his or her lips, both the force of compression of the spring 30 and the gravitational force G must be overcome. In overcoming this force, the user raises the outwardly projecting ends 26 and 28 upwardly to a level at least even with the lips, and often to an upward and outward inclination relative to the lips. The actions of the user in overcoming gravitational force, as well as force of spring compression, enhances the beneficial effects of the use of the facial muscle exercising device of the invention.

FIG. 14 illustrates use of the muscle exercising device 10 by a user whose head is in the supine position in which the user's chin 92 is at substantially the same level as the user's lips 12 and 13. When the facial muscle exercising device 10 is utilized in this manner the gravitational force G acting on the weighted facial muscle exercising device 10 acts more or less vertically downwardly. The user thereby is required to overcoming very little gravitational force acting on the facial muscle exerciser 10 when using it as shown in FIG. 14.

On the other hand, a user may employ the facial muscle exerciser of the invention in the manner shown in FIG. 15. In this method of use the user's chin 92 is located above the level of the user's lips 12 and 13. When the user deploys the facial muscle exercising device 10 in this manner, the protruding ends 26 and 28 of the lip-engaging elements 14 and 16 tend to sag downwardly, toward the user's nose under the force of gravity G until the user purses his or her lips 12 and 13. Once the cheek muscles are flexed to purse the user's lips 12 and 13, however, the gravitational force G must be overcome and the outwardly projecting ends 26 and 28 of the facial muscle exercising device 10 are forced vertically upwardly, toward the user's chin 92 as the user overcomes both the force of gravity G and the force of the coil spring 30.

Undoubtedly, numerous variations and modifications of the invention will become readily apparent to those familiar with facial muscle exercising devices and methods of exercising a person's facial muscles. Accordingly, the scope of the invention should not be construed as limited to the specific embodiments depicted and described, but rather is defined in the claims appended hereto.

I claim:

1. A facial muscle exercising device comprising:

a pair of transversely separated lip-engaging members having mutually facing sides and opposing, opposite sides in which concave outwardly facing lip-receiving grooves are formed, said lip-engaging members having exposed ends that extend longitudinally outwardly from said lip-receiving grooves, a transverse guideway defined in said exposed end of at least one of said lip-engaging members, an elongated guide element projecting from said facing side of the other of said lip-engaging members and into said guideway, and a compressed spring having opposing ends seated in said facing sides of said lip-engaging members and located longitudinally inwardly from said guide element and said guideway.

2. A facial muscle exercising device according to claim 1 wherein said lip-engaging members have cheek-engaging ends projecting from said lip-engaging grooves in a longitudinal direction opposite said exposed ends, and said opposing, opposite sides of said cheek-engaging ends are flared convex outwardly and beyond said opposite sides of said exposed ends in a transverse direction.

3. A facial muscle exercising device according to claim 2 wherein each of said exposed ends of said lip-engaging members weighs at least one ounce.

4. A facial muscle exercising device according to claim 2 further comprising detachable weights releaseably attached to the distal extremities of said exposed ends remote from said lip-receiving grooves.

5. A facial muscle exercising device according to claim 4 further comprising magnets located in said distal extremities of said exposed ends, and said detachable weights are formed of a material attracted by said magnets.

6. A facial muscle exercising device according to claim 4 wherein said detachable weights each weigh between about one and about ten ounces.

7. A facial muscle exercising device according to claim 6 wherein each of said detachable weights weighs about two ounces.

8. A facial muscle exercising device according to claim 1 wherein said one of said lip-engaging members has a guide element stop that limits the extent of withdrawal of said guide element from said guideway, thereby defining a maximum transverse distance of separation between said lip-engaging members.

9. A facial muscle exercising device according to claim 8 wherein said guide element has a shank and an enlarged head greater in cross-sectional area than the cross-sectional area of said shank at its distal end remote from said head, and said guideway in said one of said lip-engaging members has a narrower portion that intersects its facing side at a guide element shank opening and a wider portion that intersects its opposite side at a guide element head opening, and said narrower portion has a cross-sectional area greater than the cross-sectional area of said shank and less than that of said head, and said wider portion has a cross-sectional area greater than that of both said head and said shank.

10. A facial muscle exercising device according to claim 9 wherein the demarcation between said shank and said head of said guide element is formed as an abutment face, and the demarcation between said narrower and wider portions of said guideway is formed as an abutment shoulder, and said lip-engaging members reside at said maximum transverse distance of separation when said abutment face resides in contact with said abutment shoulder, and said lip-engaging members are releaseably securable close together by increased compression of said coil spring and partial engagement of said abutment face of said guide element head with said opposite side of said one of said lip-engaging members at said guide element head opening.

11. A facial muscle exercising device according to claim 8 wherein said compressed spring is a coil spring and further comprising a spacing member anchored to said facing surface of a selected lip-engaging member coaxially within the confines of said coil spring and extending transversely therefrom and terminating short of said facing surface of said other lip-engaging member at the maximum transverse distance of separation between said lip-engaging members.

12. A facial muscle exercising device according to claim 1 further comprising a guideway also defined in said other of said lip-engaging members and said guideways in said lip-engaging members are aligned with each other in a transverse direction, and said guide member includes a plurality of spaced locking openings therein and further comprising a releaseable locking member on said other of said lip-engaging members alternatively engageable in a selected one of said spaced locking openings.

13. A facial muscle exercising apparatus comprising:

a pair of transversely separated opposing lip-engaging pieces formed with mutually facing and mutually opposing sides, concave lip-engaging grooves defined on said opposing sides, protruding exposed ends projecting longitudinally out from said concave lip-engaging grooves, and wherein a transversely aligned guideway is defined in said cylindrical protruding end of a first of said lip-engaging pieces, an elongated, rigid, guide member anchored to said cylindrical end of a second of said lip-engaging pieces, and extending transversely from said facing side thereof into said guideway of said first lip-engaging piece in reciprocal, sliding engagement therewith, and a compressed spring is seated in said mutually facing sides of said lip-engaging pieces to bias said lip-engaging pieces apart.

14. A facial muscle exercising apparatus according to claim 13 further comprising cheek-engaging ends projecting longitudinally in from said concave lip-engaging grooves, and including convex, transverse outwardly flared cheek contact surfaces on said mutually opposing sides of said lip-engaging pieces.

15. A facial muscle exercising apparatus according to claim 13 wherein said compressed spring is in longitudinal alignment with said lip-engaging grooves.

16. A facial muscle exercising apparatus according to claim 15 wherein said extremities of said protruding exposed ends are formed with flat, transverse weight seating surfaces surrounded by raised, annular retaining rims with opposing finger gripping gaps defined therein, and magnets are permanently secured to said protruding, exposed ends of said lip-engaging members at said weight seating surfaces thereof, and further comprising removable weights attracted by said magnets and which are removably held to said weight seating surfaces by the magnetic force of said magnets.

17. A method for a human being to maintain muscle tone and elasticity of the cheek muscles adjacent the mouth utilizing a facial muscle exercising device having a pair of transversely separated, opposing lip-engaging pieces biased apart by a spring and formed with mutually facing and mutually opposing sides, concave lip-engaging grooves defined on said opposing sides, protruding exposed ends projecting longitudinally out from said concave lip-engaging grooves, and a transverse guide rod anchored to one of said lip-engaging pieces and extending between said mutually facing sides and into a transverse guideway in the other of said lip-engaging pieces in reciprocal sliding engagement therewith, the steps comprising:

positioning said facial muscle exercising device in one's mouth with said lip-engaging grooves disposed at the corners of one's mouth, and repetitiously pursing one's lips to contract one's cheek muscles to overcome the bias of said spring and the force of gravity on said exposed ends of said facial muscle exercising device.

18. A method according to claim 17 performed in a position in which one's chin is at a vertical level below the level of one's mouth.

19. A method according to claim 17 performed in a position in which one's chin is at the same vertical level as one's mouth.

20. A method according to claim 17 performed in a position in which one's chin is at a vertical level above the level of one's mouth.

* * * * *